US005117717A

United States Patent [19]

Mally

[11] Patent Number: 5,117,717

[45] Date of Patent: Jun. 2, 1992

[54] ON-WEIGHT SLICING SYSTEM

[75] Inventor: Timothy G. Mally, Oregon, Wis.

[73] Assignee: Oscar Mayer Foods Corporation, Madison, Wis.

[21] Appl. No.: 629,292

[22] Filed: Dec. 18, 1990

[51] Int. Cl.[5] ..... B26D 5/20; B26D 7/27

[52] U.S. Cl. ..... 83/47; 83/72; 83/364; 83/367; 83/408; 53/157; 53/DIG. 1

[58] Field of Search ..... 83/72, 76.1, 76.8, 77, 83/42, 47, 364, 367, 408, 420, 425, 425.2.425.3, 13; 53/157, DIG. 1; 100/153, 910

[56] References Cited

U.S. PATENT DOCUMENTS

| | | | |
|---|---|---|---|
| 2,768,666 | 10/1956 | Garapolo et al. . | |
| 2,966,186 | 12/1960 | Garapolo | 83/367 |
| 3,131,739 | 5/1964 | Harrington | 83/364 X |
| 3,133,571 | 5/1964 | Hensgen et al. | 83/364 |
| 3,144,893 | 8/1964 | Dahms | 83/72 X |
| 3,527,083 | 9/1970 | Hensgen | 83/724 |
| 3,642,046 | 2/1972 | Matthews, Jr. et al. . | |
| 3,762,257 | 10/1973 | Mathews, Jr. | 83/364 |
| 3,846,957 | 11/1974 | Divan | 83/774 |
| 3,890,862 | 6/1975 | Lhenry | 83/76.8 |
| 3,913,434 | 10/1975 | Smithers | 83/408 X |
| 4,208,933 | 6/1980 | Skidmore | 83/367 |
| 4,329,900 | 5/1982 | Dennis et al. | 83/355 |
| 4,548,108 | 10/1985 | Dennis | 83/27 |
| 4,572,044 | 2/1986 | Antonissen | 83/42 |
| 4,580,475 | 4/1986 | Antonissen | 83/774 |

*Primary Examiner*—Frank T. Yost

*Assistant Examiner*—Eugenia A. Jones

*Attorney, Agent, or Firm*—Lockwood, Alex, Fitzgibbon & Cummings

[57] ABSTRACT

An apparatus and method are provided for the slicing of bacon bellies or the like in a manner such that each draft of bacon is of the same weight, irrespective of the topography and density of the belly from which the draft is sliced. A dimensioner assembly has a plurality of pivotally mounted fingers having one end which engages the belly and another end which is a cam surface for transmitting movement of the fingers to a receptor such as an electromicrometer. The finges engage the top, bottom and both longitudinal sides of the belly, and the data thus collected are then transformed into a topography schematic which is particular for each specific belly passing through the dimensioner assembly. These topography data and data concerning the make-up of the particular belly are used for controlling movement of feed into a bacon slicer. Included is a feed assembly which positively and precisely feeds the belly into the slicer. Also described are a side strapping assembly for removing a selected one of the longitudinal edges of each belly, as well as an interleaver assembly that places a bacon board or the like beneath each draft thus formed. The dimensioner and controlled-feed slicing assemblies are most advantageously utilized in association with a pressing arrangement which flattens and squares off each belly in accordance with its particular free-pressing configuration and make-up.

14 Claims, 7 Drawing Sheets

ON-WEIGHT SLICING SYSTEM

BACKGROUND AND DESCRIPTION OF THE INVENTION

The present invention generally relates to an apparatus and method for automatically slicing meat items such as bacon bellies in order to provide a draft of slices which have a total weight that substantially equals a target weight. More particularly, the invention relates to an apparatus and method for slicing a substantially continuous flow of items, preferably meat items such as bacon bellies, by a system including an arrangement whereby the speed by which each individual item is fed into a slicer is determined so that on-weight slicing is achieved. The system includes determining width and thickness data for each individual item and controllably feeding the particular item into a slicing apparatus in accordance with precise conditions so that a specific target weight for a draft of slices is attained while staying within ranges of optimal slice count and slice thickness. In addition, a strapping station can be provided upstream of the slicing station in order to remove a less-desirable longitudinal edge of each item; in the case of bacon bellies, this edge is one having a very high fat content.

When treating products during food processing operations, it is at times needed to slice a bulk item into a plurality of slices. A well-known example in this regard is the slicing of bacon bellies into drafts of bacon. Typically, the draft is sold according to a total packaged weight. Bacon bellies have long been considered to be a non-uniform commodity; and as such, slicing of bellies into on-weight packages (such as one-pound packages) consisting of a discrete number of slices has been considered randomly successful. A typical approach that is used in the industry for compensating for this random success rate is using make-weights (such as one-quarter slices or one-half slices) which are manually added to a draft of slices. This is a well-accepted current method of bringing individual bacon drafts up to weight specifications. Inasmuch as it is important to avoid short weighting, it is often the case that an added quarter slice or half slice will bring the draft weight above the target weight, thereby resulting in loss of value to the producer because the drafts are sold as a product of a given, target weight, rather than according to the actual total weight of slices or partial slices. Often, in order to avoid the chance of selling an underweight package, the processor will add an extra slice or slice portion to a package.

Another aspect of sought-after uniformity for sliced bacon products and the like is to have each individual slice be of substantially the same thickness. It is, for example, generally undesirable to provide a packaged bacon product which has slices that vary in thickness, or for that matter in shape and/or size, to any significant extent. It is typically acceptable, however, that slice thickness can vary from package to package, provided the slice thickness remains within a range of suitable thicknesses.

Prior art patents such as Hensgen U.S. Pat. No. 3,527,083 generally suggest a system in which bacon is pressed into a rectangular shape and weighed. This patent suggests measuring three rectilinear dimensions thereof, and electrical signals are obtained therefrom in order to adjust the number and thickness of the slices to be cut. Antonissen U.S. Pat. No. 4,572,044 and U.S. Pat. No. 4,580,475 propose systems in which computers are programmed with functions corresponding to the non-linear weight distribution of a bacon slab to be cut in order to control the feed means in accordance with the derived anticipated weight distribution of the product. These proposals include using anticipated weight distribution data to control the feed rate to a slicer.

Also, it is generally known that a certain degree of uniformity can be achieved by pre-sorting of bellies or the like according to selected weight ranges. This type of weight sorting typically does not account for bellies that might be of the same weight but are of a different topography. A slice from a very thick belly or from a thick portion of a belly will generally weigh more than a slice of the same thickness from a thin belly or thin belly portion. Typically, slicing devices do not fully account for shape irregularities from belly to belly, nor do they typically consider differences in the density of bacon bellies and the like.

It has been found that, by proceeding in accordance with the present invention, it is possible to achieve custom slicing of each belly and the like so that the slices formed from that belly provide a draft of slices which totals a target weight. For a one-pound draft of bacon, for example, the target weight would be one pound. In addition, each individual draft will typically have slices of substantially equal thickness, and the number of slices and slice thickness will fall within a range of desired values.

In summary, the present invention includes an apparatus and method that is of a so-called smart system type whereby the operating apparatus and method are tailored according to the particular dimension and density parameters of each individual bacon belly and the like that is sliced thereby. These parameters are monitored for each individual bacon belly as it moves through the system. Data thus collected are used to control the rate of feed of each particular belly into a slicer in accordance with its actual dimension and density parameters. Included is a dimensioner assembly that collects width and thickness data which are used in developing topography data for each individual bacon belly and the like. A control assembly receives these and other data, including weight information for each particular belly or the like, in order to determine the rate at which that particular belly is to be fed into a specific slicing mechanism having a known slice timing sequence. Positive movement drive means feed each individual belly at the determined rate into the moving blade of the slicer. A plurality of slices are then collected as a draft, each draft being at the target weight, irrespective of belly topography and density. In this manner, the portion of each bacon belly or the like which makes up the draft of slices is sliced in accordance with its own specific parameters. In addition, when desired the apparatus and method include a feature whereby excess fat portions of bacon bellies are removed in accordance with a particular feature of each belly, for example, whether it be a right-hand belly or a left-hand belly.

It is accordingly a general object of the present invention to provide an improved apparatus and method for achieving slicing of items into on-weight groups or drafts.

Another object of the present invention is to provide an improved apparatus and method which automatically slices the substantially continuous stream of items such as meat items including bacon bellies, the slicing being tailored to specific characteristics of each item in the flow of items.

Another object of this invention is to provide an improved apparatus and method for automatically collecting the dimensions of each one of a flow of sliceable items such as bacon bellies and using that data in determining the feed rate into a slicing blade which is needed in order to achieve a plurality of slices having a target total weight.

Another object of this invention is to provide an improved apparatus and method whereby, during slicing of pressed bacon bellies, each belly will be sliced at a feed rate to provide slices of substantially equal thickness which have a combined weight totalling a target value such as one pound.

Another object of this invention is to provide an improved slicing method and apparatus including a side strapping operation wherein a fat portion of each bacon belly is removed prior to slicing.

Another object of the present invention is to provide an improved apparatus and method wherein belly slicing into drafts of bacon slices is accomplished with improved efficiencies and minimization of waste to achieve significant increases in the quantity of drafts of bacon slices obtained from a stream of processed pork bellies.

Another object of this invention is to provide an improved apparatus and method of slicing bacon drafts wherein there is a minimization of any need to manually correct draft weights.

Another object of the present invention is to provide an improved apparatus and method for slicing bacon bellies at higher line speeds.

These and other objects, features and advantages of the present invention will be clearly understood through a consideration of the following detailed description.

BRIEF DESCRIPTION OF THE DRAWINGS

In the course of this description, reference will be made to the attached drawings, wherein:

FIG. 7 is a side elevational view of a bacon board placer or interleaver for placing drafts of slices onto bacon boards and the like.

DESCRIPTION OF THE PARTICULAR EMBODIMENTS

Figure 1:
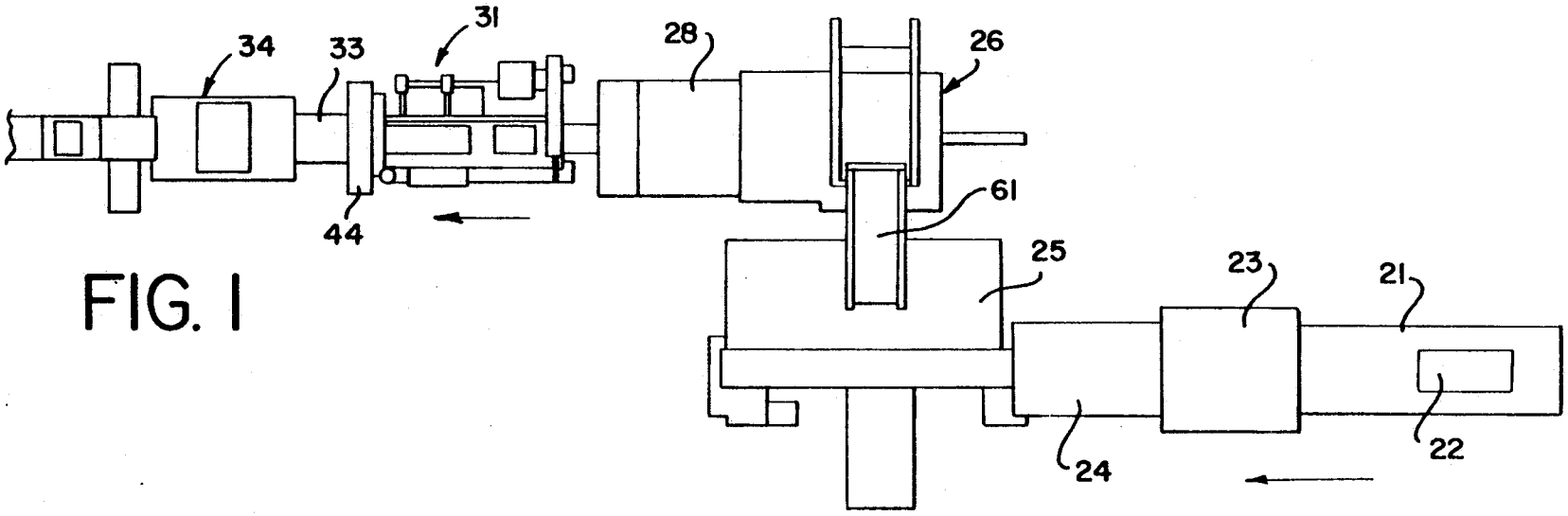
FIG. 1 is a generally schematic, top plan view of a portion of a bacon belly processing line which incorporates the present invention.

FIG. 1 provides a somewhat schematic illustration of a portion of a bacon processing line which incorporates aspects of the present invention. While the illustrated line is for handling meat items and particularly bacon bellies, the principles of the invention can be carried out on other items which are sliceable and which need to be sliced and assembled into drafts or packages containing a specified weight of equal thickness slices of the item.

Figure 2:
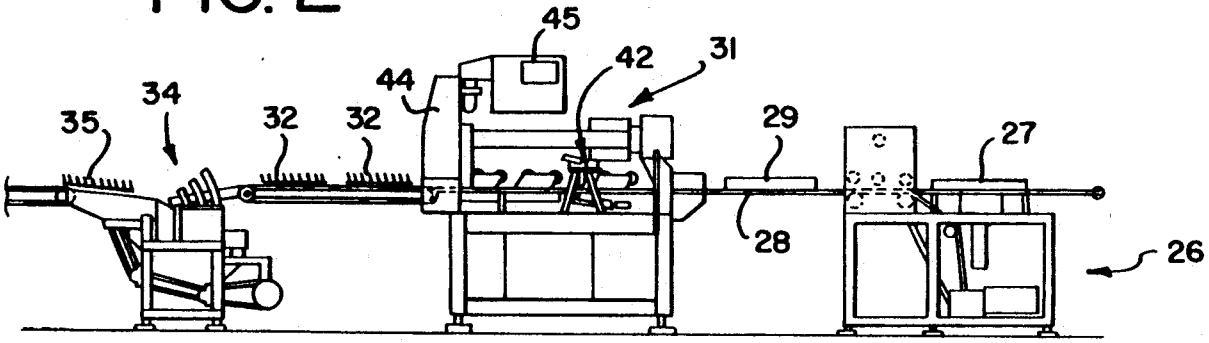
FIG. 2 is a generally schematic side elevational view of some of the bacon belly processing line portion that is shown in FIG. 1.

In the embodiment illustrated in FIG. 1, bacon bellies which have been injected with brine and otherwise subjected to treatment such as flavoring treatments, smoking and the like are deposited onto a loading and centering station 21. Bacon bellies 22 are decombed from an upstream processing station (not shown). In the illustrated arrangement, each belly 22 then flows through a flattener station 23, a conveyor scale 24, and a pressing station 25. Details of an embodiment of a pressing station and of a flattener station are found in U.S. Pat. No. 4,967,652 of Timothy G. Mally the subject matter thereof being incorporated by reference hereinto. FIG. 1 next shows a side strapper station 26 within which pressed bellies 27 (FIG. 2) are subjected to a cutting operation. A transfer or slicer infeed conveyor 28 receives pressed and side-strapped bellies 29 (FIG. 2), weighs them individually, and transfers the flow thereof to an on-weight slicing station, generally designated as 31. Each belly 29 is thereby transformed into one or more drafts 32 of bacon slices. Preferably, spacing between drafts 32 is provided by a suitable jump conveyor 33 or the like of generally known construction. Each draft is next shown passing to an interleaver station, generally designated as 34. Additional stations can be provided downstream, including ones to check on the fat content, weight and appearance of each interleaved draft 35. Suitable packaging arrangements can also be included at a downstream location.

When processed bellies 22 are received at the flattener station 23, they are typically curled. Each belly is conveyed through the flattener station 23, within which an overhead roller or the like flattens each belly. It is preferred that, immediately after flattening, belly thickness is measured. Also, the weight of each belly is determined on the conveyor scale 24, which weight is recorded for future pressing calculations. A suitable sensor (not shown) such as a "photoeye" is provided at the downstream end portion of the conveyor scale 24 in order to measure the length of each belly. Pressing station 25 can include a mechanical loading arrangement, which loading preferably takes place from the rear of the pressing station 25. Pressing station 25 uses the size and weight information previously collected for each individual belly in order to determine the specific size to which each belly is to be pressed. Each pressed belly 27 is thereby reshaped to have any overall configuration which is flatter and more rectangular than a typical belly which has undergone brine, flavoring, smoking and/or similar treatments. The pressing station accomplishes this without causing wrinkles, damage or over-working of the bellies.

Figure 3:
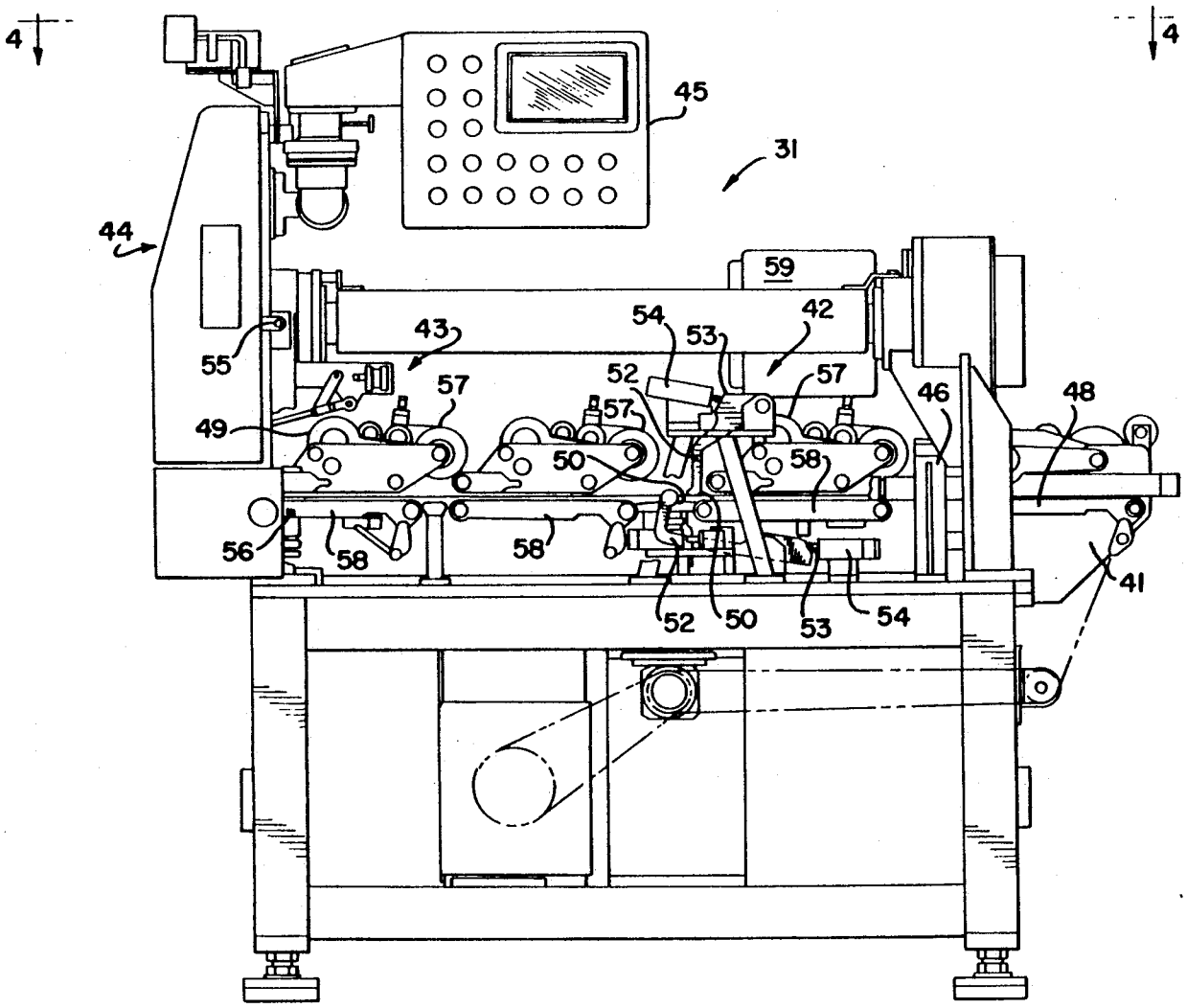
FIG. 3 is a side elevational view of a preferred assembly according to the present invention which incorporates a positive feed mechanism, a dimensioning assembly and a slicing station.
Figure 4:
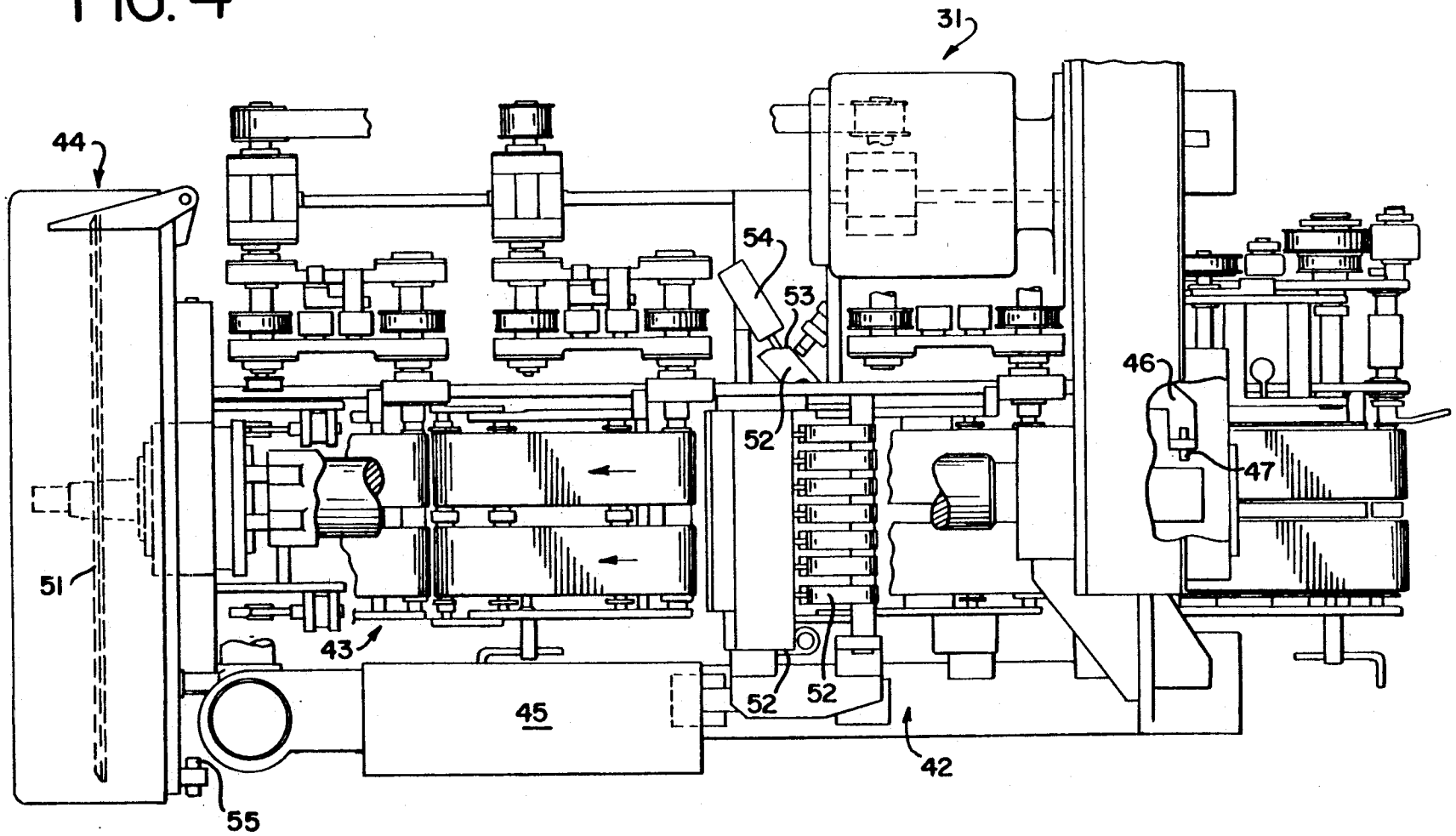
FIG. 4 is a top plan view of the assembly illustrated in FIG. 3.

Further details concerning the on-weight slicing station 31 are shown in FIGS. 3 and 4. Included are an infeed conveyor assembly 41, which receives bellies from the transfer conveyor 28. Downstream thereof is a dimensioner assembly, generally designated as 42, a belly drive assembly, generally designated as 43, a slicer assembly, generally designated as 44, and a control assembly 45. Infeed conveyor assembly 41 operates as a staging area, preferably engages the bellies with pin rollers, and conveys each belly 29 in a positive manner in order to initiate registration of each belly within the on-weight slicing station 31. Included at a downstream end portion of the infeed conveyor assembly 41 is a sensor assembly 46 including a proximity switch 47 or the like so as to determine and track the exact location of each belly 29. Infeed conveyor assembly 41 preferably includes a lower belt take-up assembly 48.

Each belly 29 is fed into the dimensioner assembly 42. This assembly, typically in association with other components such as the infeed or weigh conveyor 28 and the sensor assembly 46, provide specific parameter data for each specific belly 29 before it is fed into the slicer assembly 44, such data typically including length, width, thickness and weight. These data are fed to the control assembly 45, operated upon and stored for providing instructions to the belly drive assembly 43.

The drive instructions are in accordance with a slicing plan for the individual belly. The slicing plan instructs the belly drive assembly 43 and the slicing assembly 44 where the first full slice of bacon is to be taken on the particular belly, the thickness of each slice, the number of slices for each draft 32, and, if desired, whether or not the draft will meet a particularly high standard of bacon quality. Approximately 20,000 inputs of data are processed by the control assembly 45. From this, a topographical schematic is developed for each belly. The topographical schematic, including its length, width, thickness and weight information, can be used to determine the density of each individual belly according to the general relationship that density is weight divided by volume, with volume being length times width times thickness. If it is desired to calculate the length or to check a measured length, this can be determined by the relationship, derived from the basic definition of density, that length equals weight divided by density, times width, times thickness, in those instances where density data are available either by direct measurement or by density values generally known for bacon bellies or the like, such as the typical density of bacon bellies falling within one or more weight classifications or the like. The slicing plan includes an evaluation of these data in order to determine a feed rate number to be transmitted to a servomotor drive 49 for feeding each specific belly 29 into bacon knife or blade 51 of the slicer assembly 44. The feed rate number is a function of the length of uncut belly to be used in making the draft divided by the slice thickness.

Control assembly 45 includes data regarding desired optimal slice count and slice thickness ranges. If the slice thickness or the number of slices calculated by the control assembly fall outside of either of these slice count or slice thickness ranges, the control assembly will recalculate slice count and slice thickness so that both fall within the predetermined ranges. These predetermined ranges are selected in order to meet perceived user preferences and/or requirements that there be no more than a specified maximum number and no greater than a specified minimum number of slices of bacon and that the thickness of each slice be between a maximum specified value and a minimum specified value.

Referring more particularly to the dimensioner assembly 42, a plurality of fingers 52 engage the top, bottom, right-side and left-side of each belly as it passes through the dimensioner assembly 42. Each finger 52 has a free end surface 50 for engaging the bellies. Each finger 52 is pivotally mounted such that a cam surface 53 of each finger 52 engages an electromicrometer 54. Each electromicrometer transforms movement of the cam surface 53 associated therewith into an electrical signal which is transmitted to the control assembly in a manner generally well-known in the art. In effect, varying the gap sensed by the electromicrometer varies the voltage output, which is transformed into a digital signal processed by the control assembly 45.

Typically, the extent of movement of the free end 50 of each of the fingers 52 and the curve of each cam surface 53 cooperate such that movement of the free end over a travel length of about 2½ inches provides a linear relationship between the free end movement and movement of the sensor pin of the electromicrometer. For example, if the free end travel movement of 2 inches corresponds to an electromicrometer pin movement of 0.8 inch, a free end movement of 1 inch would correspond to an electromicrometer pin movement of 0.4 inch.

Once the topography of a particular belly has been determined by operation of the dimensioner assembly 42 and the control assembly 45, it is important to accurately drive the belly into the slicer assembly 44. In this regard, the closed loop servomotor drive 49 moves each belly in a controlled and accurate manner, and the exact position of each belly is confirmed by suitable detection means, such as the illustrated proximity switches 55 and 56. Upper belt take-up assemblies 57 and lower belt take-up assemblies 58 are preferably provided. A drive motor 59 rotates the blade 51 in a manner well-known in the art.

Figure 5:
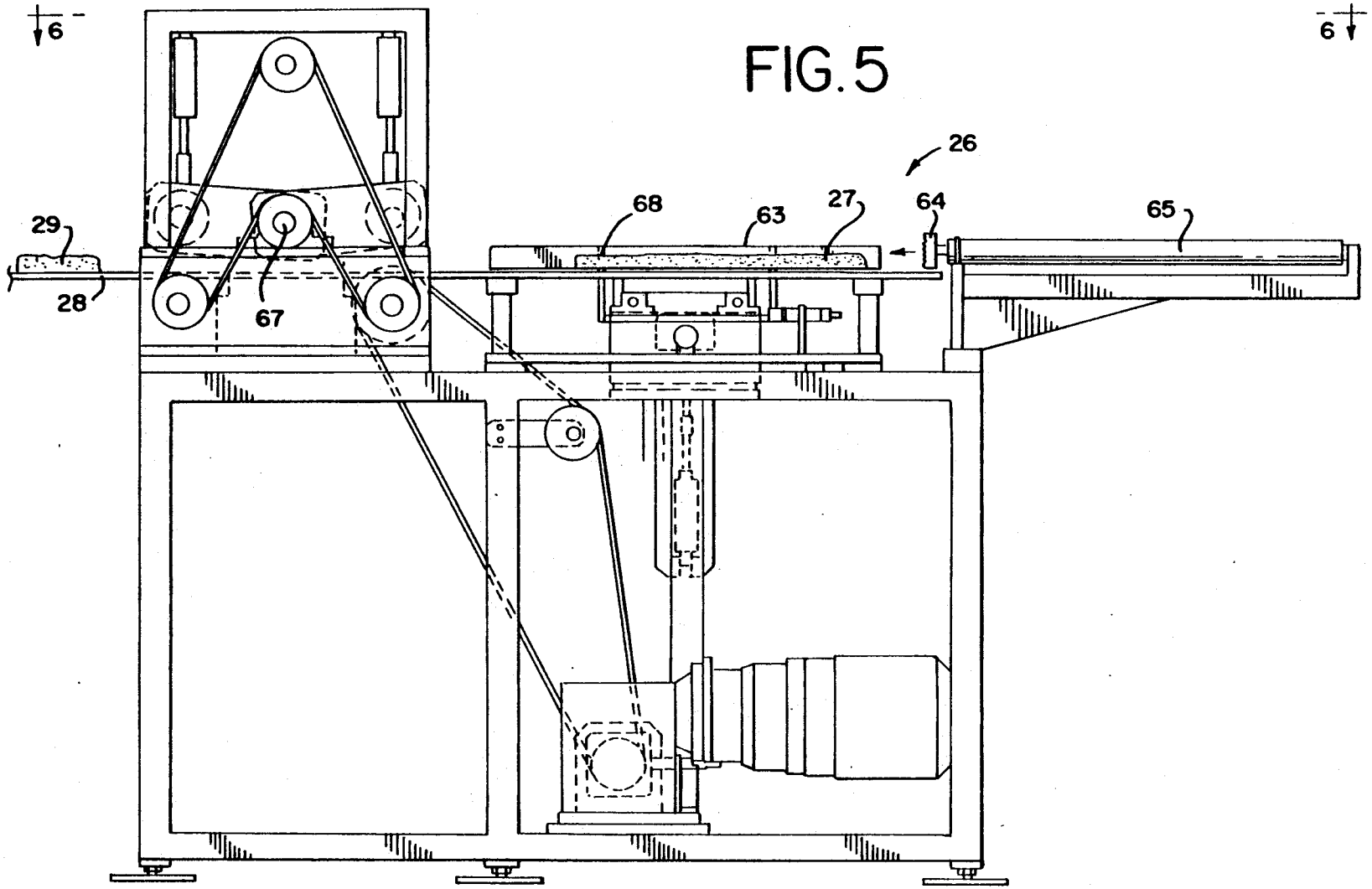
FIG. 5 is a side elevational view of a side strapping station according to the present invention.
Figure 6:
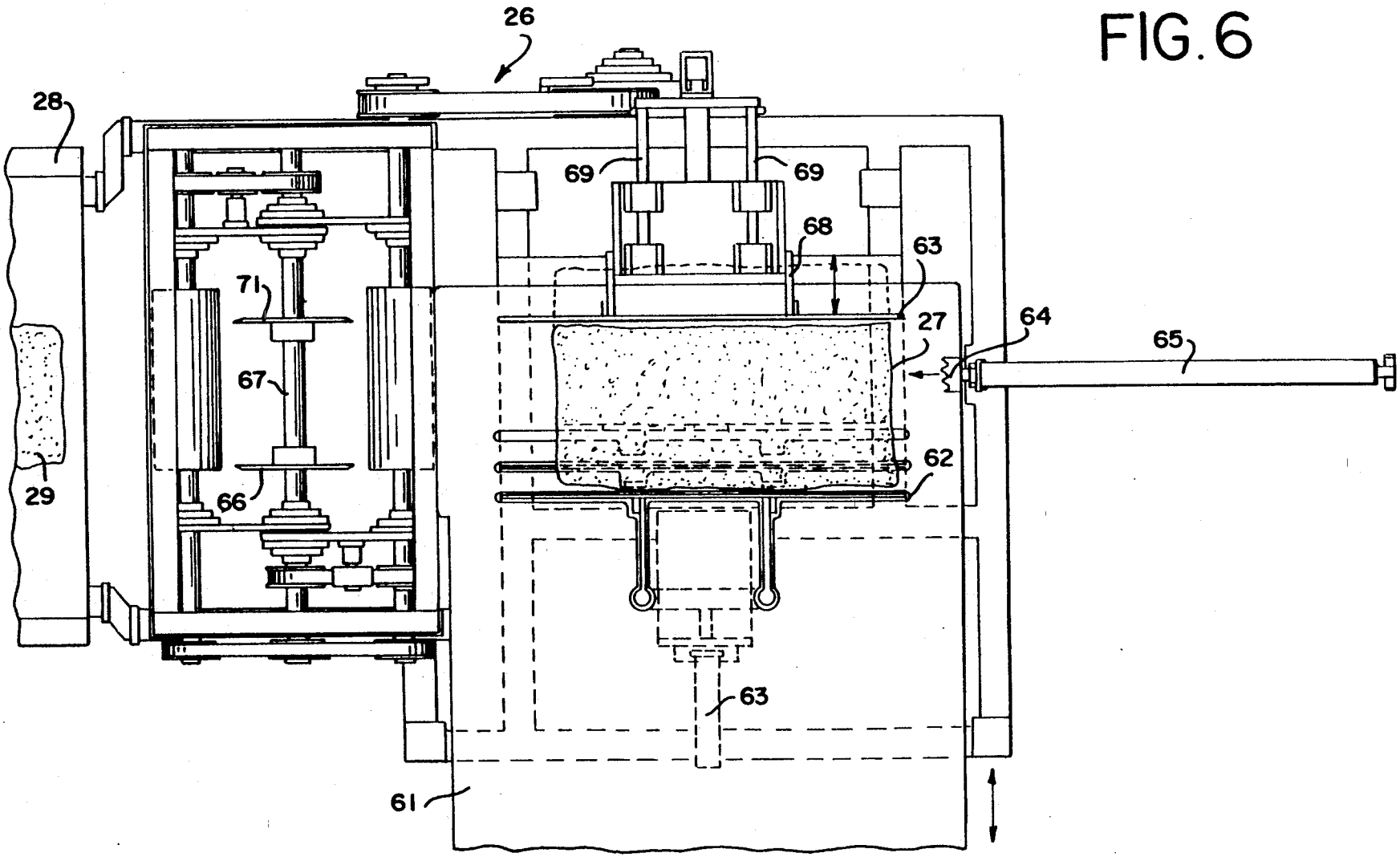
FIG. 6 is a top plan view of the side strapping station shown in FIG. 5.

FIGS. 5 and 6 further illustrate the side strapper station 26. At some point upstream of the side strapper station, means are provided, such as operator input at the loading and centering station 21 as to whether the particular belly is a right-hand or left-hand belly (depending upon the side of the pig from which the belly was taken) in accordance with a well-recognized distinction between belly types. For example, an operator could press a button or a detector could be activated to indicate "right" or "left" for each belly passing a specified upstream location, and this data would be transmitted to the side strapper station 26 in order to determine which longitudinal edge of the belly is removed thereby in order to cut excess width (typically having a high fat content) from each individual belly.

A slide plate 61 moves a pressed belly 27 into general position for side strapping. Belly 27 is illustrated in FIG. 6 in position for removal of its left longitudinal edge (the bottom edge as viewed in FIG. 6). At this location, the belly 27 is positioned between a stop plate 62 (which may move up and down to accommodate passage of the belly 27 on the slide plate 61) and a pusher plate 63. Once thus positioned, a pusher 64 is moved by its cylinder 65 to thereby engage the belly 27 and push it into and through a blade 66 such as the one illustrated in the drawings which is mounted to rotating shaft 67. In this manner, the belly 27 is side strapped and moved onto the transfer or slice infeed conveyor 28 as side strapped belly 29. If the belly is one from which the opposite longitudinal edge is to be removed, a cylinder or the like (not shown) retracts the pusher plate 63 and its slide bracket 68 along slide rods 69. In this instance, stop plate 62 is oriented so as to engage the other longitudinal edge of this belly, as generally shown in phantom in FIG. 6. This belly is then moved into and through blade 71 as illustrated, and this side strapped belly is deposited onto the transfer or slicer infeed conveyor 28.

Figure 7:
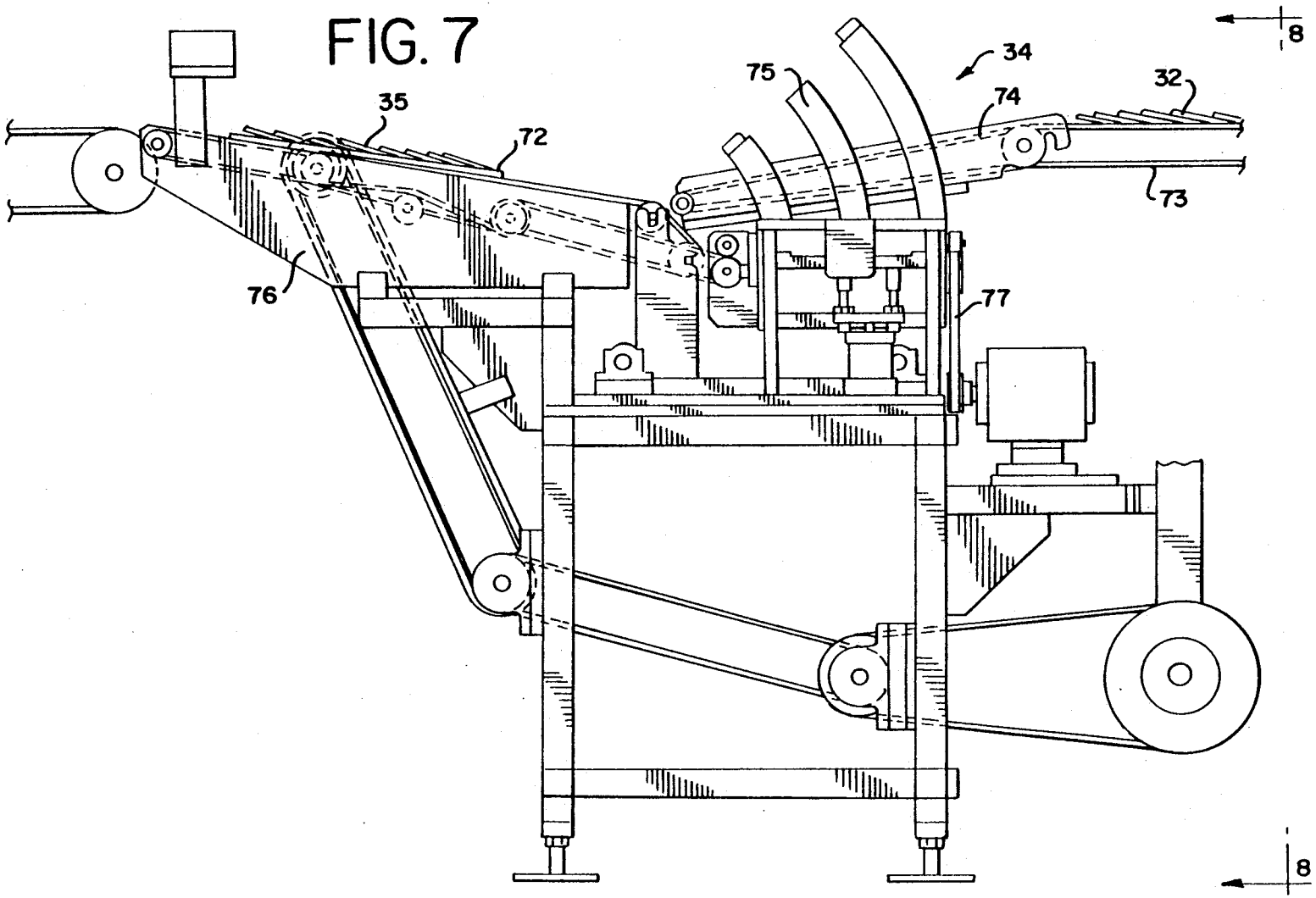
Figure 8:
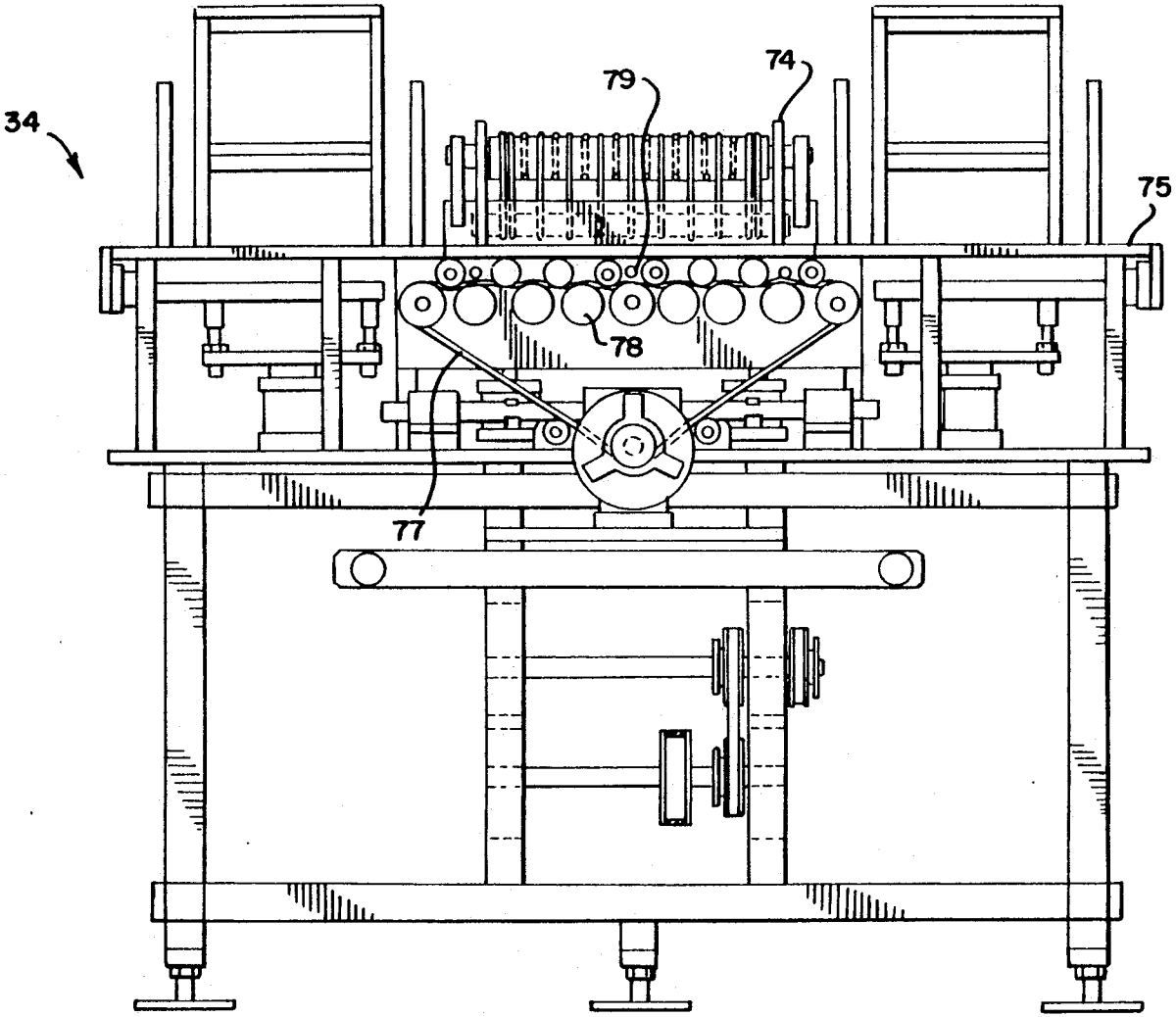
FIG. 8 is an end elevational view of the board placer station shown in FIG. 7.

An interleaver station 34 which is suitable for use in the present system is illustrated in FIGS. 7 and 8. In this illustrated embodiment, each draft 32 is interleaved with a so-called bacon board 72. Each draft of slices 32 formed at the on-weight slicing station is transferred by conveyor assembly 73, which may include a jump conveyor in order to appropriately space the drafts 32, onto an incline conveyor 74. A board placer assembly 75 positions a board 72 underneath each draft 32 when the draft 32 is on the incline conveyor 74. Thereafter, the draft 35 and its board 72 move onto a transfer conveyor 76 for any needed downstream operations such as inspection, sorting, packaging and the like. A timing belt 77 is associated with the board placer assembly 75. Timing belt 77 passes through rollers 78 and standoffs 79.

While particular embodiments of the invention have been described, it will be apparent to those skilled in the art that various modifications thereof may be made without departing from the true spirit and scope of the invention. Accordingly, it is intended by the appended claims to cover all such modifications and equivalents which embody the inventive features as defined in the claims.

I claim:

1. An apparatus for on-weight slicing of a flow of sliceable items into slices which combine to provide a draft having a target total weight by accurately measuring each individual sliceable item and determining the number and thickness of draft slices of such individual sliceable item that provide the target total weight, comprising:

infeed means for receiving and feeding a flow of a plurality of sliceable food items such as bacon bellies;

a dimensioner assembly for receiving each of said sliceable items and for determining width and thickness data for each of said items, said dimensioner assembly including a plurality of pivotally mounted fingers, each said finger having a free end for engagement of the sliceable item and another end having a cam surface that engages means for transforming movement of said cam surface into a control signal;

said cam surface of each said finger has a generally sinusoidal shape so as to provide linear relationship between the free end of the finger and the means for transforming movement of said cam surface into a control signal, whereby movement of the free end is linearly translated into movement of a receptor member of said means for transforming movement of said cam surface into a control signal;

means for slicing each of said items into a draft having a plurality of slices when each sliceable item is fed thereto;

drive means for feeding each sliceable item into said slicing means and for precisely providing and maintaining a feed rate for each individual sliceable item into said slicing means;

control means for determining said rate at which said drive means feeds each said individual sliceable item into the slicing means, said feed rate being that feed rate needed to produce the draft to have a target total weight;

said control means further determining, from data including that from said dimensioner assembly, the number of slices and the slice thickness of each said slices which will combine to provide the draft of the target total weight, said means combining to provide a plurality of slices of equal thickness having a weight totalling said draft target weight, whereby the number of slices and the equal thickness of those slices vary from draft to draft in accordance with said control means data; and means for receiving the slices from said slicing means to thereby provide a flow of drafts composed of a plurality of said slices, each said draft having said target total weight.

2. The apparatus in accordance with claim 1, wherein said means for transforming movement is an electromicrometer.

3. The apparatus in accordance with claim 1, wherein said dimensioner assembly includes a plurality of said fingers for engaging a top surface of the sliceable item, a plurality of said fingers for engaging a bottom surface of the sliceable item, at least one said finger for engaging a right side of the sliceable item, and at least one said finger for engaging a left side of the sliceable item.

4. The apparatus in accordance with claim 1, further including a side strapping assembly upstream of said infeed means, said side strapping assembly having means for positioning each sliceable item with respect to a blade member of the side strapping assembly, said positioning means allowing for selection between a right-hand orientation and a left-hand orientation of said sliceable item, and means for transporting into the blade member the sliceable item which had been positioned by the positioning means, whereby either the right-hand longitudinal edge or the left-hand longitudinal edge of the sliceable item is severed from the sliceable item.

5. The apparatus in accordance with claim 4, wherein said side strapping assembly includes at least two blade members having respective slicing planes generally parallel to each other, and wherein said positioning means aligns each sliceable item for slicing engagement with one of said two blade members to sever the left-hand side of each sliceable item having a left-hand orientation or for slicing engagement with the other of said two blade members to sever the right-hand side of each sliceable item having a right-hand orientation.

6. The apparatus in accordance with claim 1, further including pressing means upstream of said infeed means, said pressing means being for flattening and squaring the sliceable items prior to entry into the dimensioner assembly and slicing means.

7. The apparatus in accordance with claim 1, further including interleaver means downstream of said receiving means, said interleaver means placing a support member below said drafts.

8. An apparatus for on-weight slicing of a flow of sliceable items, comprising:

a side strapping assembly, said side strapping assembly having means for positioning each of a series of sliceable bacon belly items with respect to a blade member of the side strapping assembly, said positioning means allowing for selection between a right-hand orientation and a left-hand orientation of said sliceable item, and means for transporting into a slicing plane of the blade member the sliceable item which had been positioned by the positioning means, said transporting means moving said sliceable item in a direction generally parallel to, into and through the slicing plane of the blade member, whereby either the right-hand longitudinal edge or the left-hand longitudinal edge of the sliceable item is severed from the sliceable item to form a side strapped item;

a dimensioner assembly for receiving each of said side strapped items and for determining width and thickness data for each of said items, said dimensioner assembly including a plurality of pivotally mounted fingers, each said finger having a free end for engagement of the sliceable item and another end having a cam surface that engages means for transforming movement of said cam surface into a control signal;

said cam surface of each said finger has a generally sinusoidal shape so as to provide a linear relationship between the free end of the finger and the means for transforming movement of said cam surface into a control signal, whereby movement of the free end is linearly translated into movement of a receptor member of said means for transforming movement of said cam surface into a control signal;

means for slicing each of said items into a draft having a plurality of slices when each sliceable item is fed thereto;

drive means for feeding each sliceable item into said slicing means and for precisely providing and maintaining a feed rate for each individual sliceable item into said slicing means;

control means for determining said feed rate at which said drive means feeds each said individual sliceable item into the slicing means, said feed rate being that feed rate needed to produce the draft to have a target total weight by determining the number of slices and the slice thickness of each said slices which will combine to provide the draft of the target total weight and for providing a plurality of slices of equal thickness having a weight totalling said draft target weight, whereby the number of slices and the equal thickness of those slices vary from draft to draft in accordance with variations from sliceable item to sliceable item; and means for receiving the slices from said slicing means to thereby provide a flow of drafts composed of a plurality of said slices, each said draft having said target total weight.

9. The apparatus in accordance with claim 8, wherein said means for transforming movement is an electromicrometer.

10. The apparatus in accordance with claim 8, further including pressing means upstream of said side strapping assembly, said pressing means being for flattening and squaring the sliceable items prior to entry into the dimensioner assembly and slicing means.

11. The apparatus in accordance with claim 8, wherein said side strapping assembly includes at least two blade members having respective slicing planes generally parallel to each other, and wherein said positioning means aligns each sliceable item for slicing engagement with one of said two blade members to sever the left-hand side of each sliceable item having a left-hand orientation or for slicing engagement with the other of said two blade members to sever the right-hand side of each sliceable item having a right-hand orientation.

12. A method for on-weight slicing of a flow of sliceable items, comprising the steps of:

infeeding a flow of a plurality of sliceable food items such as bacon bellies, each of said sliceable food items having a top surface, a bottom surface, a right side and a left side;

a dimensioning step for receiving each of said sliceable items and for determining width and thickness data for each of said items, said dimensioning step including engaging a free end of each of a plurality of fingers with a sliceable item, thereby moving a cam surface of the finger to provide a control signal;

linearly translating said moving of the fingers into width and thickness data having a linear relationship to the actual width and thickness of each individual sliceable item, said linearly translating step including imparting a generally sinusoidal shape to said cam surface;

determining a rate at which each said individual sliceable item is fed for slicing, said determining step processing said data from said dimensioning and linearly translating steps to determine a feed rate needed to produce each draft to have a target total weight by determining the number of slices and the thickness of each said slices which will combine to provide the draft of the target total weight when each slice has substantially the same thickness;

feeding each sliceable item and precisely providing and maintaining said feed rate for each individual sliceable item;

slicing each of said items for forming a draft having a plurality of slices of equal thickness when each sliceable item is fed thereto, said slicing step forming a plurality of said drafts having a plurality of said slices of equal thickness, which equal thickness varies from draft to draft in accordance with said data; and receiving the slices from said slicing means to thereby provide a flow of drafts composed of a plurality of said slices, each said draft having said target total weight.

13. The method in accordance with claim 12, wherein, prior to said infeeding step, each sliceable item is positioned with respect to a blade member, said positioning step including selecting between a right-hand orientation and a left-hand orientation of each said sliceable item, pushing each thus oriented sliceable item into the blade member and severing either the right-hand longitudinal edge or the left-hand longitudinal edge from each said sliceable item.

14. The method in accordance with claim 12, wherein said dimensioning step engages ones of the fingers with the top surface, bottom surface, right side and left side of each said sliceable item.

* * * * *